US005148655A

United States Patent [19]

Salinas

[11] Patent Number: 5,148,655

[45] Date of Patent: Sep. 22, 1992

[54] SLICER AND BAGGER FOR SUBSTANTIALLY FLAT FOOD PRODUCTS

[76] Inventor: Bart Salinas, 1207 S. Airhart Dr., Baytown, Tex. 77520

[21] Appl. No.: 652,550

[22] Filed: Feb. 8, 1991

[51] Int. Cl.[5] ..... B65B 63/00

[52] U.S. Cl. ..... 53/514; 43/245; 43/516

[58] Field of Search ..... 53/245, 513, 514, 515, 53/516, 517, 518, 519, 535, 570, 435; 99/537; 83/408, 425, 437

[56] References Cited

U.S. PATENT DOCUMENTS

| | | | |
|---|---|---|---|
| 2,092,763 | 9/1937 | Le Frank | 53/435 |
| 2,168,579 | 8/1939 | Perreton | 53/514 |
| 2,247,650 | 7/1941 | Carlson | 83/437 |
| 2,852,053 | 9/1958 | Berry et al. | 83/437 |
| 3,959,951 | 6/1976 | Paules | 53/535 X |
| 4,027,460 | 6/1977 | Orr | 53/535 |
| 4,062,260 | 7/1977 | Steinhogl | 83/437 X |
| 4,186,543 | 2/1980 | Lyell | 53/515 |
| 4,416,103 | 11/1983 | Ewer et al. | 53/517 |
| 4,537,017 | 8/1985 | Hengstenberg et al. | 53/515 |

*Primary Examiner*—Robert L. Spruill

*Assistant Examiner*—Daniel B. Moon

*Attorney, Agent, or Firm*—Parks & Associates

[57] ABSTRACT

An apparatus for slicing and bagging substantially flat food products comprising a frame and a holder conforming to the shape of the food product to be sliced for holding the food in vertical stacked alignment and removably attached to the frame and having at least one slicer faced toward the food product to be sliced and mounted across the holder; and a ram having recessed sections conforming with the slicer for completely driving the food products through the slicer and completely slicing the food products without contacting the slicer, and a coordinated follower positioned below the slicer, a small but effective distance from the slicer for receiving the food products as they are sliced and for preventing the food products from being flayed out of the vertical stacked alignment as the food is sliced and a bagging apparatus for progressively bagging the food as it is sliced and received from the slicer. In one embodiment, the ram and the coordinated follower operate to control the small but effective distance for the controlled flaying of the product sliced, while the sliced food product remains in vertical stacked alignment.

10 Claims, 4 Drawing Sheets

SLICER AND BAGGER FOR SUBSTANTIALLY FLAT FOOD PRODUCTS

BACKGROUND OF INVENTION

This invention relates to improvements in a food slicing and bagging apparatus for simultaneously slicing and bagging substantially flat food products having a frame and a food product holder which conforms to the shape of the food product and thus holds the food in vertical stacked alignment for slicing. The holder is removably attached to the frame and has at least one slicer faced toward the food products to be sliced. Further this invention relates to a ram having recessed sections on its surface for conforming with the slicer which allows the ram to completely drive the food products through the slicer and not contact the slicer. Also, this invention further relates to having a coordinated follower which co-ordinates with the ram movement and is located below the slicer a small but effective distance for receiving the food products as they are sliced. The coordinated movement of the follower and the ram maintain the small but effective distance from the slicer to prevent the food products from being flayed out of vertical stacked alignment as it is sliced. Also this invention has a bagging apparatus for progressively bagging the food products sliced. In at least one embodiment the food products are tortillas.

While it is old in the prior art to provide various forms of slicing apparatus or equipment, most of these apparatuses were designed to slice the food products and drop the food products into a collection system directly below the slicer and there was no concern in the prior art for the orientation of the sliced products as they were sliced and dropped into the collection system. The prior art usually provided separate machinery and apparatuses to align the products that had been sliced and dropped below to the collection system.

In at least one type of food to be sliced i.e. tortilla, the food is semi-cooked into flat circular disks and they are fed from the ovens and stacked. In the prior art they were stacked and sliced, by various means ranging from hand held and powered slicers to mechanical slicers. However, in the prior art they were sliced and then dropped onto conveyer belts and delivered to bagging operations. In this prior art, however, in the dropping of the food products as they were cut, the cut pieces were turned in many directions i.e., flayed and thus required the bags to be quite large to accommodate a significant volume of the food products because of their unordered orientation in the bags.

Further, by being turned over and flayed completely by the prior art slicers, they were exposed to air and had a tendency to dry out and loose their freshness while in shipment or storage.

Also, in the prior art there has been a problem with slicers jamming, because at least in tortillas and pita bread food products, the product is very dense and slightly gummy when stacked for slicing.

In addition to jamming, the prior art slicers had a tendency to tear or unevenly cut the food products and leave jagged edges and cut pieces which were not a uniform size and shape.

Further, the prior art was also limited to slicing only small numbers of individual food product to be sliced either because of the jamming or tearing of the product if more than a few pieces of the product were sliced at one time.

Some of the prior art apparatuses turned the cut pieces of food product such as tortillas over because it was important that they were flayed and some air be placed between the cut pieces before shipment less they became stuck together and could not be separated for final cooking. In the prior art, it was a problem to both cut these tortillas and control their flay sufficiently for air exposure, but not so great an amount to create bulky storage which allows too much air to be placed between them and caused spoilage and staling.

SUMMARY OF THE INVENTION

This invention relates to a novel apparatus for slicing and bagging substantially flat disk shaped food products such as tortillas, pita breads and other foods of a similar nature. The apparatus of this invention is designed to provide a complete "one-step" system of slicing and bagging all in one operation.

It is the object of this invention to provide a slicing of substantially flat food products and provide a controlled flaying or aeration of the products between each individual piece of the product but not so great a flaying as to take the food product out of its stacked vertical alignment, either during slicing or bagging.

It is also the object of this invention to provide a bagger which is positioned for receiving the products as they are sliced and delivered from the slicing operation.

It is yet a further object of this invention to provide a slicing apparatus which may cut large quantities of food products, like tortillas, in quantities of a dozen or more at one time and bag the products without additional handling of the cut food product.

It is the object of this invention to provide an apparatus for slicing a dozen or more pieces of food product at one time and in one operation.

It is a further object of this invention to provide a bagging operation which receives the sliced food products in a vertical stacked alignment as bagged.

It is a further object of this invention to provide a bagger which allows the bagging of a dozen or more food product pieces in vertical stacked alignment.

It is a further object of this invention to provide a large surface area ram which is capable of distributing the slicing forces evenly across the surface of the food products to be sliced and at the same time providing the ability to push the food product completely through all the product to be sliced at one operation without the ram engaging the slicing blades and dulling the slicing blades.

It is a further object of this invention to provide a holder for receiving the food products and holding them in vertical stacked alignment while providing a constant distance between the food product being sliced and a catching surface, either formed from a following means for the food products as they are sliced and/or by the food products already sliced forming a catching surface for receiving the newly sliced materials on top of previously sliced pieces of the food product.

DETAILED DESCRIPTION

Figure 1:
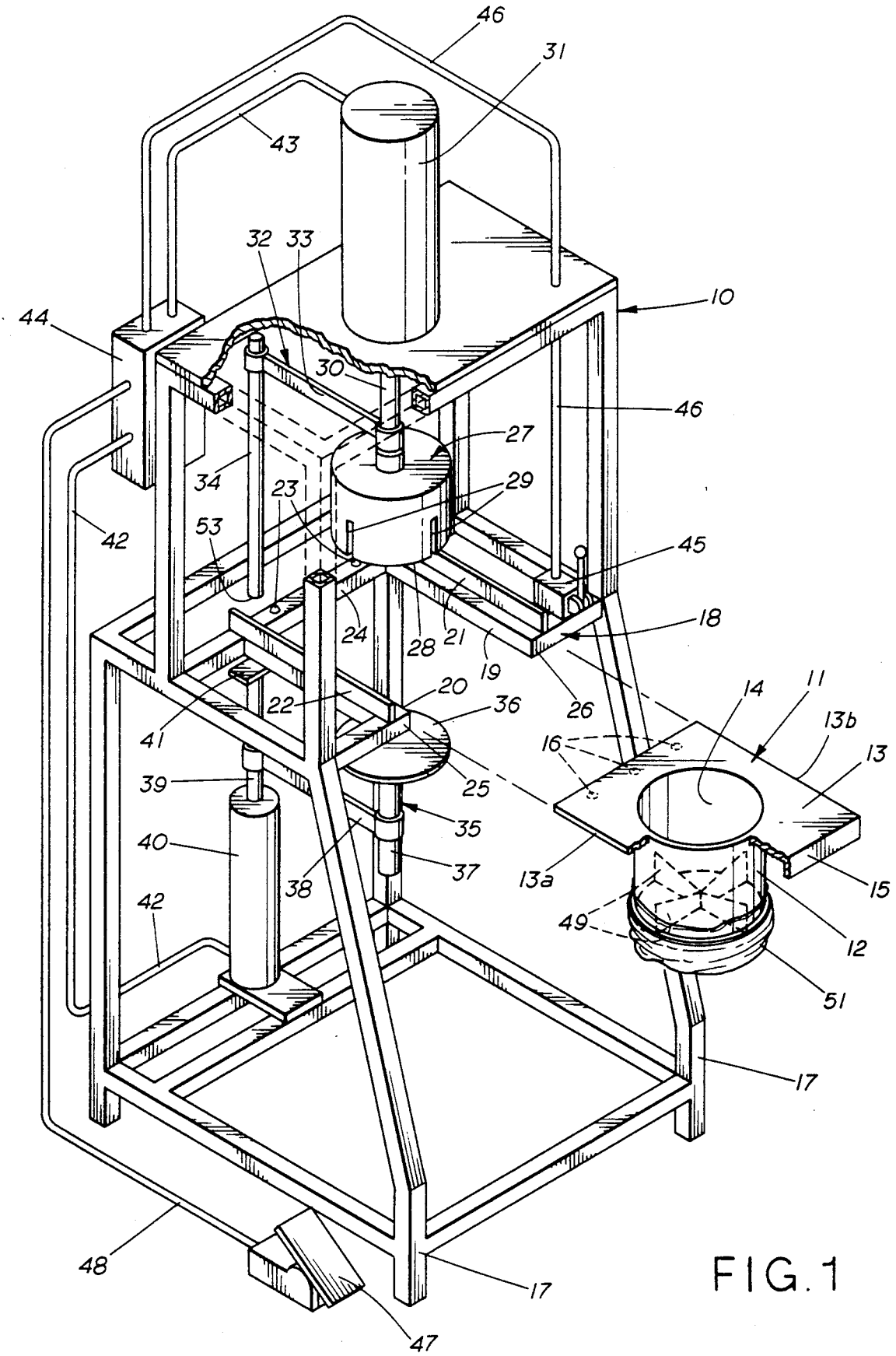
FIG. 1 is a perspective view of the apparatus of this invention with the holder member removed from the frame.
Figure 2:
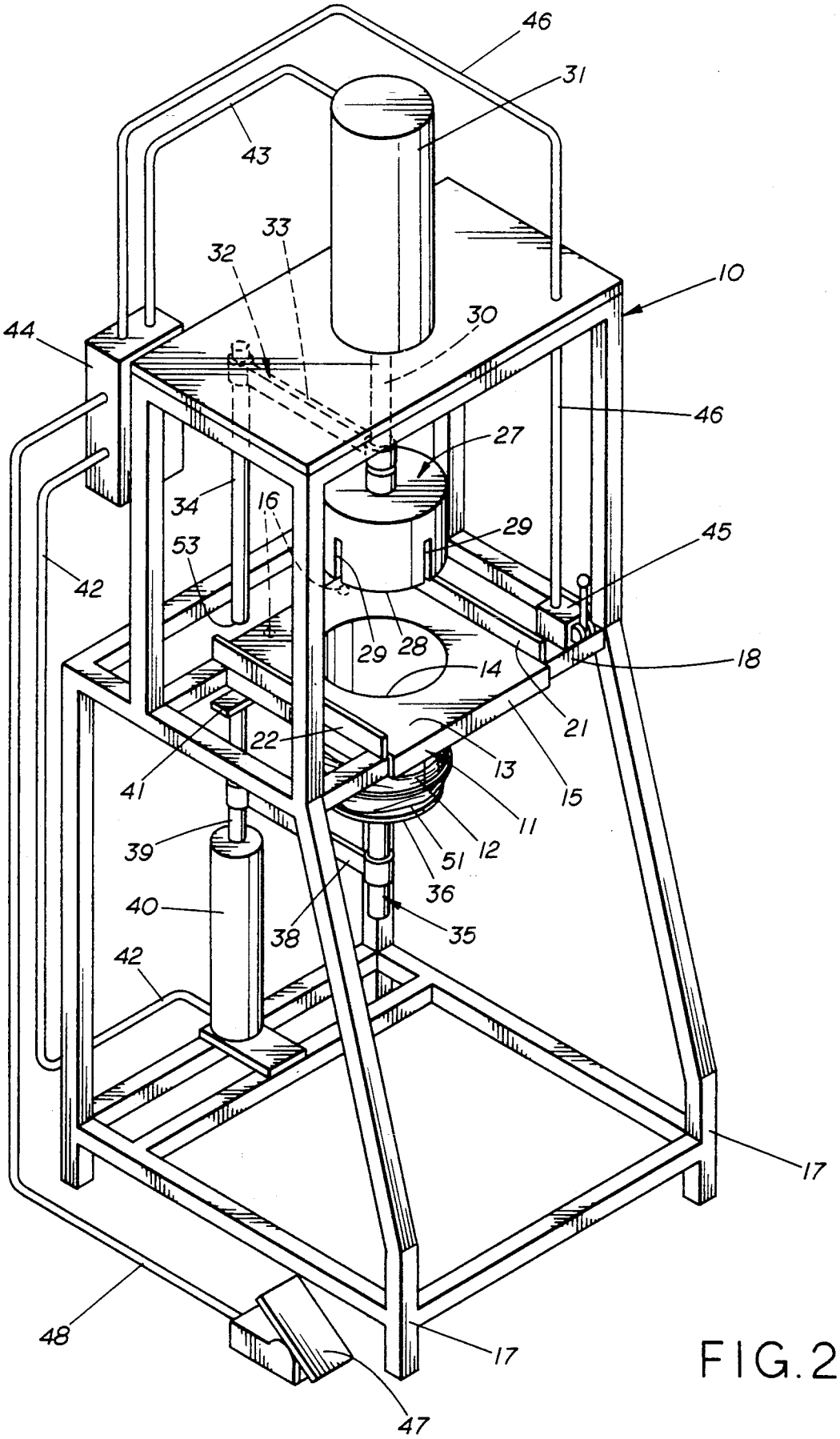
FIG. 2 is a perspective view of the apparatus of this invention with the removable holder member mounted on the frame beneath the ram and above the follower member.

Referring now to the drawings, the frame 10 is shown generally in FIG. 1. The removable holder apparatus 11 is shown removably detached from the frame 10. In FIG. 2, the removable holder apparatus 11 is shown removably attached to the frame 10 as it would be during the slicing operation. The removable holder apparatus 11 is removable for refilling and preparing for additional slicing and bagging of the substantially flat food product. It should be understood that the frame 10 could be formed in any shape and could even be formed as a frame design to hold multiple removable holder apparatus 11 in a circular relation for slicing and bagging the substantially flat food product of this invention as the removable holder apparatus 11 is rotated into its proper position on the frame. In this configuration, a number of removable holder apparatuses 11 could be made available beneath the slicer one at a time while others are being filled and removably connected to the frame 10.

It should be further understood that the removable holder apparatus 11 of this particular embodiment is formed into a shape which substantially conforms to the food product to be sliced for holding the food product in vertical stacked alignment. In this particular embodiment as in FIG. 1, the removable holder apparatus 11 has formed therein a cylinder 12 for receiving the food product of tortillas. The cylinder 12 in this embodiment is further attached to a slide plate 13 which has slide surface 13(*a*) and slide surface 13(*b*) and aperture 14 formed therein for passing the tortillas through the slide plate 13 and into the cylinder 12.

In at least one embodiment of holder apparatus 11 connected to the slide plate 13 is a flang handle 15 which facilitates the sliding of the removable holder apparatus 11 into and out of the frame 10 and also in some embodiments serves as a positioning stop against frame 10.

Also in this embodiment, aligning concave indentions 16 are provided on the slide plate 13 for properly aligning and positioning the removable holder apparatus 11 on the frame 10.

Referring now to the frame 10, the frame 10, in this embodiment is provided with base legs 17, for support of frame 10 and for positioning a slide table 18 on frame 10 at a convenient height for a worker to insert the removable holder apparatus 11 therein. The slide table 18 in this embodiment is provided with at least a pair of slide surfaces 19 and 20 for sliding engagement with the slide surface 13(*a*) and slide surface 13(*b*) on slide plate 13, such that when the removable holder apparatus 11 is inserted into the frame 10 on the slide table 18, the slide surfaces 13(*a*) and 13(*b*) are slidable and are engaged along slide surfaces 19 and 20 of the slide table 18 for receiving the removable holder apparatus 11 into place on the frame 10. Side guards 21 and 22 guide the slide surfaces 13(*a*) and 13(*b*) to aid in aligning the aperture 14 of removable holder apparatus 11 into proper alignment for operation of this apparatus once the removable holder apparatus 11 is fully placed in the frame 10.

Detent pins 23 are provided on the rear surface 24 of the slide table 18 for engaging the aligning concave indentions 16 on the removable holder apparatus 11 to provide concave surfaces to receive the detent pins 23 therein when the removable holder apparatus 11 is fully in place and aligned on the slide table 18. To further aid in this alignment process, the flang handle 15 will abut against the slide table 18 at stopping members 25 and 26 in some embodiments. In at least some embodiments, an electrical switching circuit can be provided to give an electrical read-out when the detent pins 23 and concave indentions 16 are fully and properly in contact so that an operator will have an electrical signal sent to a transducer which provides a visual indication of the ready status of the food slicer of this invention.

Also connected to the frame 10 is a ram member 27, having a substantially flat head 28 but for recessed sections 29 therein. Connected to the ram member 27 is a piston shaft 30 which is in turn connected to a upper double acting fluid driven piston 31 for moving the piston shaft 30 and ram member 27 up and down. Connected to the piston shaft 30 is a timing linkage 32 which is in this embodiment composed of a horizontal element 33 and a vertical element 34 for transmitting the motion of the ram member 27, and the piston shaft 30 caused by the upper double acting fluid driven piston 31.

Also connected to the frame 10 is a follower member 35 which is positioned in its attachment to the frame 10 to be below the slide table 18 and the removable holder apparatus 11 when said removable holder apparatus 11 is in place on said slide table 18. It should be understood by those skilled in the art that the positioning of the follower member 35 relative to the removable holder apparatus 11 should be a small but effective distance from the slicer for receiving said food product as said food product is sliced and for preventing said food product from being flayed out of vertical stacked alignment as the food product is sliced. It should be further understood that to provide and maintain the small but effective distance for controlling the flaying of the food product being sliced, depends on the size of the pieces of the food to be sliced, such that smaller pieces would require smaller distances and large pieces would require greater distances between the food to be sliced and the follower member 35. The follower member 35 is composed of a receiving plate 36 for receiving the sliced food product and a connecting rod 37. The connecting rod 37 is connected to a horizontal shaft 38 which is then in turn connected to a vertical shaft 39 which is connected to a lower double acting fluid driven piston 40 on one end and the other end of vertical shaft 39, is provided with a striking surface 41. The striking surface 41 is designed to activate the lower double acting fluid piston 40 to track at the same speed that the upper double acting fluid driven piston 31 is driving the piston shaft 30 and the ram member 27. Thus, the speed of the follower member 35 in its motion away from the removable holder apparatus 11 is the same rate of movement as the ram member 27. By moving the follower member 35 away at the same rate as the ram member 27 is moving downward and slicing the food product, the follower member 35 and its receiving plate 36 do not stack up with sliced food, but keep a constant distance between the food being sliced and that already sliced, even as food is sliced and dropped.

The pistons 40 and 31 are in one embodiment fluid driven. It should be understood that fluid lines 42 and 43 would be passed to a controller box 44 where the fluids used to drive pistons 31 and 40 are reservoired and then re-driven back to the respective piston 31 and 40 as needed in response to the controls in controller box 44.

In at least one embodiment shown in FIG. 1, an actuator member 45 is attached to the frame 10, and connected by fluid lines 46 for the operator to commence the operation once the removable holder apparatus 11 is filled with the food to be sliced and it has been inserted into the slide table 18. Also connected to the frame 10 is a foot actuator 47 for resetting the pistons 31 and 40 after a slicing of the food product has occurred. This resetting of the pistons 31 and 40 is done in preparation for slicing additional food product. The foot actuator 47 is connected to the controller box 44 by fluid line 48. The importance of the side guards 21 and 22 and the detent pins 23 can be seen here because if aperture 14 is not properly aligned with ram member 27 when it is actuated, the ram member 27 will strike the slide plate 13 and either jam the ram member 27 or cause it to miss the aperture 14 and make the apparatus inoperable.

Figure 3:
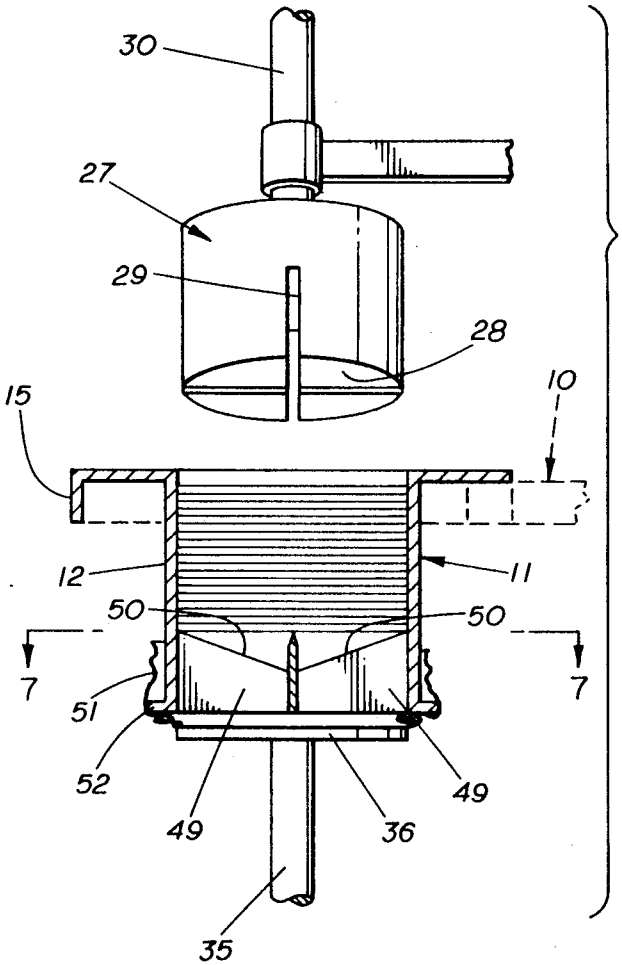
FIG. 3 is a diagrammatic view of the holder member and slicing blades in place with the substantially flat food product placed in the holder and showing the ram member in perspective view positioned above the holder member.

Referring now to FIG. 3 wherein the removable holder apparatus 11 has been loaded with representations of flat food products (in this example, tortillas) and loaded into the frame 10, it can be seen in FIG. 3 that the shape of the removable holder apparatus 11 substantially conforms to the shape of the food product to be sliced as the cylinder 12 substantially surrounds the food product to be sliced. In this view of FIG. 3, the flange handle 15 can be seen as it would be grasped by an individual putting the removable holder apparatus 11 into the slide table 18. (Not shown in FIG. 3). Also shown in FIG. 3 are the slicing blades 49 which are sized to fit completely across the removable holder apparatus 11 and are positioned in this embodiment within the removable holder apparatus 11 for providing slicing blades 49 against which the food will be driven upon commencement of the slicing.

The slicing blades 49 have slicing surfaces 50 which are sloped downward to the center of the removable holder apparatus 11 for providing a diagonal cutting surface relative to the food product to be sliced. This downward sloped slicing surface 50 provides a gradual slicing of the tortillas rather than trying to cut them all at once and requires less force. Also, by also having downward sloped slicing surfaces 50 slope to the center, the slicing forces tend to concentrate the cutting forces starting from the outside edge and move to the center of the product in the stack of food products and makes for a cleaner cut and prevents jamming of the removable holder apparatus 11 by food getting jammed between the walls of the cylinder 12 and the ram member 27. This also makes for even cuts and uniform product sizes with large quantities of the product being sliced at one time.

As seen in FIG. 3 the follower member 35 and the receiving plate 36 are positioned a small but effective distance from the slicing blades 49 and slicing surfaces 50 thus, preventing the food product from being flayed out of their vertical stack alignment as the food products are sliced and delivered into a bag 51 on receiving plate 36.

The bagging stage of receiving the food product as the food product is sliced and for progressively bagging the food products as the food products are sliced, and received from the slicer is provided generally by a bag feeder having a lip 52 which is formed about the cylinder 12 of sufficient circumference as to slightly stretch the bag 51 which is placed over the lip 52 and up the sides of the cylinder 12. The purpose for the engagement of lip 52 by the bag 51 is for resistance against the bag to prevent the bag from inadverently slipping off the cylinder 12 and the lip 52. Thus, as the tortillas are cut, they will fall on a receiving plate 36, a small but effective distance, until they strike the bottom of the bag 51 and the follower member 35, but once a sufficient quantity of sliced tortillas has been sliced, the follower member 35 begins to pull away and the bag 51 is progressively pulled free of the lip 52 and the cylinder 12, thus, pulling the bag 51 up the sides of the sliced tortillas as they are sliced and delivered until all the tortilla pieces are cut and the full bag 51 is pulled off the lip 52 and the cylinder 12 and the bagged product removed from the receiving plate 36 and the follower member 35.

Figure 5:
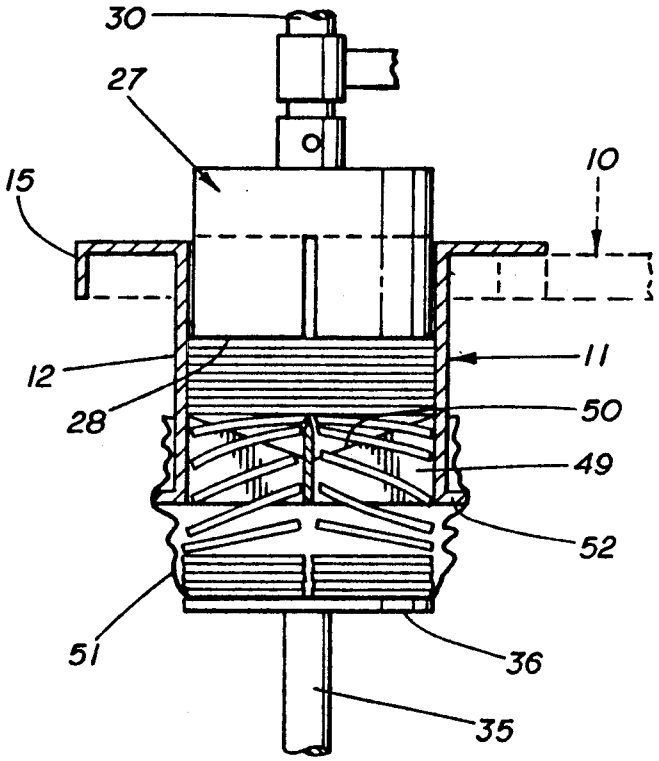
FIG. 5 shows the ram; holder member; and the follower member in operation with part of the food product having been sliced and diagrammatically showing the controlled flaying of the product while the product is being held to its vertical stacked alignment from beginning of the slicing operation to the finish of the slicing of the food product and through its being bagged.

Referring to FIG. 5, it can be seen that the cutting process has commenced in FIG. 5 and the ram member 27 and flat head 28 are pressing the tortillas or food to be sliced through the slicing blades 49. From the diagrammatic drawing of FIG. 5, it can be seen that as the food is sliced, it is sliced from the outside edge to the center of cylinder 12, therefore as the food product is sliced, the part that is released first is that part nearest the outside wall of cylinder 12 which gradually flays the sliced piece downward as it is cut until it is completely cut and dropped on the bag 51 on receiving plate 36. It can be seen that the small but effective distance between the final cutting point of the food product on the slicer is such that it allows the sliced pieces to tilt forward and be flayed and aerated, but at the same time it is not so long a distance as to allow the sliced piece to be flayed or turned completely over and out of vertical alignment, thus, by controlling the distance of follower member 35 and the speed by which follower member 35 is moved in conjunction with the speed of the ram member 27, the slicing operation provides a control flaying to aerate the product but not so much flaying as to destroy the vertical stacked alignment of the food product after it is sliced.

Figure 7:
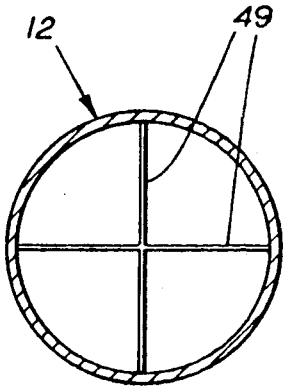
FIG. 7 is a view along line 7—7 of FIG. 3.
Figure 6:
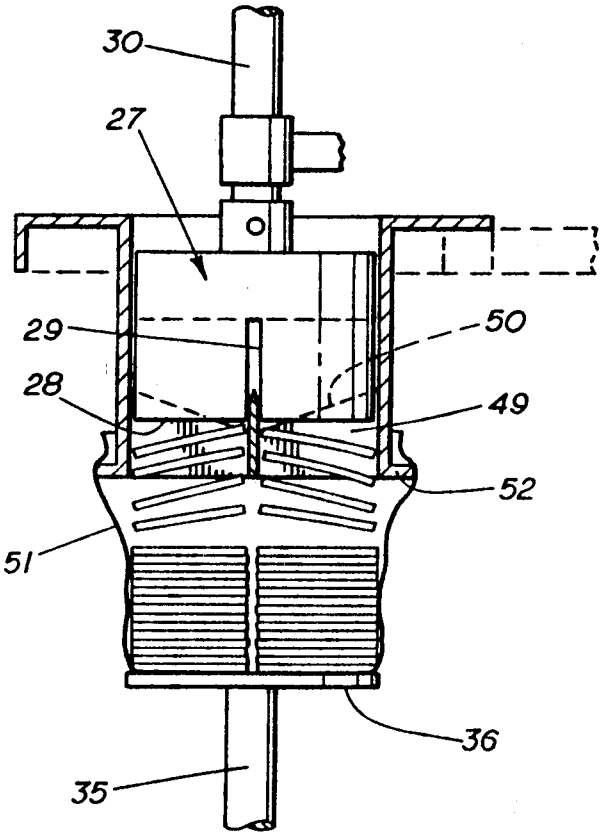
FIG. 6 shows the same diagrammatic representation as FIG. 5 except the product is fully sliced and completely located within the bag and the follower apparatus has moved away from the slicer blades and has maintained the small but effective distance from the slicer blades to the catching surface for preventing the food from being flayed out of its vertical stacked alignment.

Further, in FIG. 1 and 6, the recessed section 29 on the ram member 27 can be seen to align with the slicing blades 49 so that the ram member 27 can pass food product completely through the slicing blades 49 and force all the food product through the slicing blades 49, without the slicing blades 49 engaging the ram member 27. It can be seen in FIG. 7, which is a top view of the removable holder apparatus 11 that the slicing blades 49 are located at right angles to each other in one embodiment. The criss-cross slicing blades 49 provide support to the individual slicing blades 49 and provide a slicing into four (4) separate pieces as each piece of food product is passed therethrough.

Figure 4:
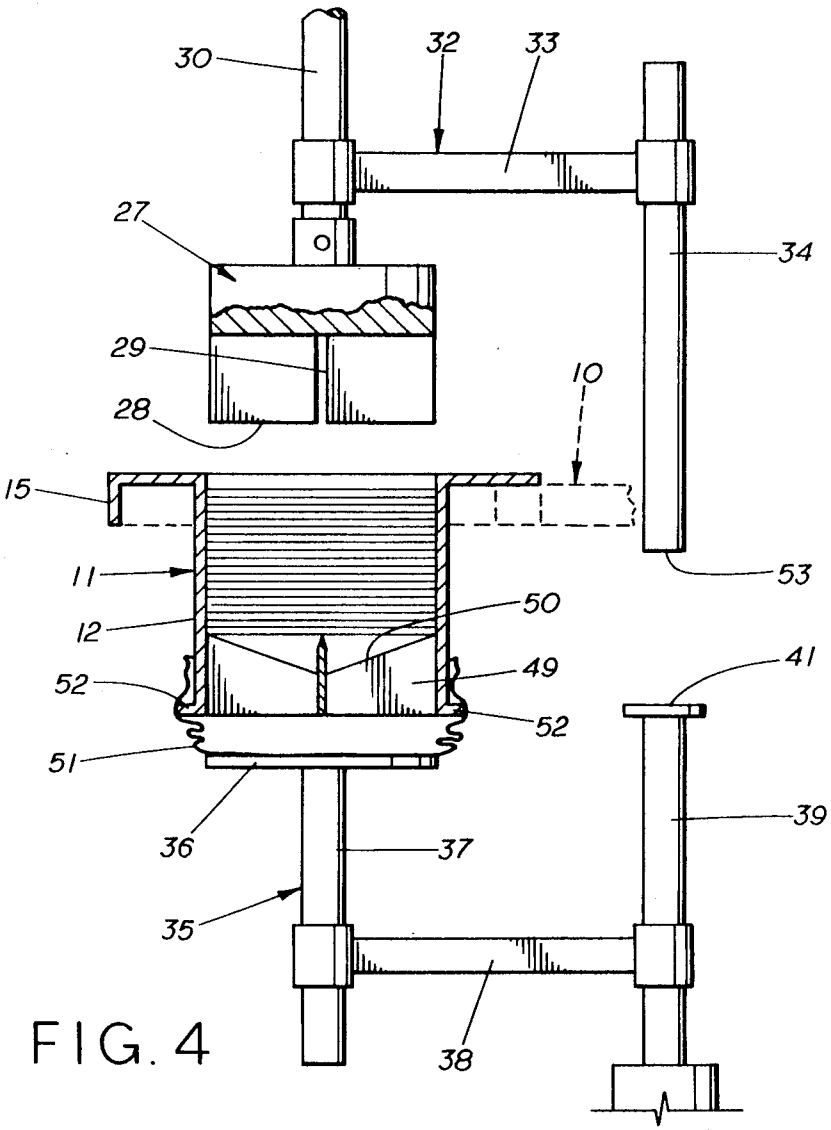
FIG. 4 is a diagrammatic view with the holder member positioned above the bagging member and below the ram member and showing the relationship between the follower member, the ram member and the slicing blades for providing a small but effective distance from the follower member and the slicing blades for receiving the food product as it is sliced.

Referring now to FIG. 4, where diagrammatically the timing linkage 32 is shown, it can be seen that as the follower member 35 pulls away from the removable holder apparatus 11, the tortillas are simultaneously delivered into the bag 51 and the force of the tortillas delivered to the bottom of the bag 51, which is a product of mass and acceleration of the tortillas, will begin to cause the bag to be pulled over the lip 52 and pull the bag 51 all the way around the tortillas being sliced.

In the embodiment of FIG. 4, a delaying means of a gap is provided between the vertical element 34 of the timing linkage 32 and the vertical shaft 39 such that as the piston shaft 30 is driven downward so also is the vertical element 34. Located on the vertical element 34 is an engaging surface 53 which engages a striking surface 41, on vertical shaft 39 which actuates the horizontal shaft 38 to be moved at the same speed as vertical element 34 but only after the delay contact created by the distance of the gap between vertical element 34 and vertical shaft 39. Thus, the follower member 35 and receiving plate 36 and the vertical shaft 39 are moved away from the slicing blades 49 at the same rate that the ram member 27 is being advanced and cutting the tortillas which provides a constant small but effective distance between the slicing blades 49 and the follower member 35 and receiving plate 36 and/or the tortillas which form the flat surface also for the tortillas as they are cut and laid thereon and which themselves prevent flaying of the product except for the controlled flaying.

In FIG. 6 it can be seen that the ram member 27 has completely advanced all the tortilla food product through the slicing blades 49 but stops short of engaging the recessed sections 29 of the ram member 27 against the slicing surfaces 50. Also, the recessed sections 29 are laid out to conform with the configuration of the slicing blades 49, but still provide as much surface area on flat head 28 as possible for spreading the force of the ram member 27 over as much of the food surface as possible. It will be appreciated by those skilled in the art that if too great a pressure point were created on the food product, the food products would be subject to tearing or providing an uneven cut piece.

It can be seen here that the bag 51 has been controllably removed from the lip 52 and the cylinder 12 such that the bag 51 is completely filled with sliced pieces which are vertically stacked and aligned. The follower member 35 has moved sufficiently downward to allow the bag to be completely filled.

It should be appreciated that at the bottom of the cycle, a foot actuator 47, (not shown in FIG. 6 but in FIG. 1) is used to reset the follower member 35 and to reset the ram member 27.

It should be understood that while in this embodiment, the slicing blades 49 and the lip 52 are constructed as a single piece, it is possible to have separate pieces without departing from the scope of this invention and would also lend itself to yet further automation for higher volumes.

I claim:

1. An apparatus for slicing and bagging substantially flat food products comprising;

a. A frame;

b. a holder means substantially conforming to the shape of said food products to be sliced for holding said food products in vertical stacked alignment, including means to removably attach said holder means to said frame;

c. a slicer means having at least one slicer surface faced toward said food products to be sliced and means positioning said at least one slicer surface across and proximate said holder means for slicing said food products;

d. a ram means having formed therein recessed sections which correspond with said slicer means for completely driving said food products through said slicer means and completely slicing said food products without said ram means contacting said slicer means;

e. a follower means positioned below said slicer means a small but effective distance from said slicer means for receiving said food products as said food products are sliced and for preventing said food products from being flayed out of their vertical stacked alignment as said food products are sliced; and f. a bagging means for receiving said food products as said food products are sliced and for progressively bagging said food products as said food products are sliced and received from said slicer means.

2. The apparatus of claim 1 wherein said bagging means further comprises a bag holder means mounted proximate said holder means.

3. The apparatus of claim 2 wherein said bag holder means further comprises;

a. an inside wall formed in said bag holder means for substantially conforming to the shape of said food products to be sliced and providing an aperture through said bag holder means for allowing said sliced food products to pass there through in vertical stacked alignment; and b. an outside wall for receiving a bag thereover for holding said bag as said food products are sliced and delivered through said aperture into said bag.

4. The apparatus of claim 3 wherein said bag holder means further comprises a bag feeder means mounted proximate said outside wall of said bag holder and sized for sufficient engagement of said bag to prevent said bags removal except upon receiving the sliced food product.

5. The apparatus of claim 4 wherein said bag feeder means comprises a lip formed about the cutside wall of said bag holder means, for controlled frictional engagement of a bag sufficient to prevent said bag from dropping off, but sufficient to be pulled off upon progressively receiving said food products therein.

6. The apparatus of claim 4 wherein said slicer means having at least one slicer surface comprises a slicer surface having an edge sloped downwardly toward the center of the slicer means for providing an inclined slicing surface for directing the slicing moment forces toward the center of said slicer means.

7. The apparatus of claim 6 wherein said slicer means further comprises a first slicer blade and a second slicer blade mounted at right angles to each other and engaged to support each other at said downward sloped center edge for rigidity of said slicer means during slicing.

8. The apparatus of claim 4 further comprising a fluid driven means connected to said follower means for coordinated movement of said follower means away from said slicer means for maintaining said small but effective distance for allowing the food product to flay as sliced but not so great a distance as to flay said food product out of vertical stacked alignment.

9. The apparatus of claim 8 further comprising a means for linking said ram means with said fluid driven means connected to said follower means for coordinating the rate of slicing and drive of said ram means with the rate of coordinated movement away from said food products slicer means by said follower means for maintaining said small but effective distance for controlling the degree to which said food products flay as sliced.

10. The apparatus of claim 9 further comprising a delaying means for time delaying the means for linking said ram means with said fluid driven means connected to said follower means for allowing said ram means to commence slicing said food products before said follower means is actuated for coordinated movement away from said food products slicer means.

* * * * *